US007473162B1

(12) United States Patent
Sung et al.

(10) Patent No.: US 7,473,162 B1
(45) Date of Patent: Jan. 6, 2009

(54) PAD CONDITIONER DRESSER WITH VARYING PRESSURE

(76) Inventors: Chien-Min Sung, 64 Chung-San Rd., Ying-Ko Factory, Taipei County 23911 (TW); Yang-Liang Pai, No. 5, Lane 7, Sec. 1, Sin Hai Rd., Taipei City 100 (TW)

( * ) Notice: Subject to any disclaimer, the term of this patent is extended or adjusted under 35 U.S.C. 154(b) by 0 days.

(21) Appl. No.: 11/349,034

(22) Filed: Feb. 6, 2006

(51) Int. Cl.
*B24B 49/18* (2006.01)

(52) U.S. Cl. ..... 451/21; 451/56

(58) Field of Classification Search ..... 451/21, 451/443, 444, 72, 56, 5
See application file for complete search history.

(56) References Cited

U.S. PATENT DOCUMENTS 5,834,377 A * 11/1998 Chen et al. ..... 438/693
5,913,714 A 6/1999 Volodarsky et al.
6,059,636 A * 5/2000 Inaba et al. ..... 451/5
6,191,038 B1 2/2001 Yoshida et al.
6,220,936 B1 4/2001 Quek
6,402,588 B1 6/2002 Matsuo et al.
6,416,617 B2 7/2002 Yoshida et al.
6,517,414 B1 * 2/2003 Tobin et al. ..... 451/8
6,561,875 B1 5/2003 Homma et al.
6,575,820 B2 6/2003 Liu et al.
6,616,513 B1 * 9/2003 Osterheld ..... 451/56
6,733,363 B2 * 5/2004 Moore ..... 451/5
7,089,081 B2 * 8/2006 Palmgren ..... 700/175
7,210,981 B2 * 5/2007 Yilmaz et al. ..... 451/8
2003/0166383 A1 9/2003 Kumura et al.

OTHER PUBLICATIONS

James C. Sung, Chi-Ting Yang, Pei-Wen Hung, Yunn-Shiuan Liao, Yang-Liang Pai, Diamond Wear Pattern of CMP Pad Conditioner, VMIC, 2004, 15 pages, Taiwan.
Ming-Yi Tsai, Yunn-Shiuan Liao, James C. Sung, Yang-Liang Pai, DMP Pad Dressing with Oriented Diamond, VMIC, 2004, 5 pages, Taiwan.

* cited by examiner

*Primary Examiner*—Robert Rose
(74) *Attorney, Agent, or Firm*—Thorpe North & Western LLP

(57) ABSTRACT

Methods for extending the service life of a CMP pad dresser having a substrate and a plurality of superabrasive particles disposed thereon which is used to dress a CMP pad are disclosed and described. Generally, the method may include dressing the chemical mechanical polishing pad with the dresser and varying pressure between the pad and the dresser in relation to superabrasive particle wear, such that the dresser life is extended.

35 Claims, 2 Drawing Sheets

PAD CONDITIONER DRESSER WITH VARYING PRESSURE

FIELD OF THE INVENTION

The present invention relates generally to methods for dressing or conditioning a chemical mechanical polishing (CMP) pad. Accordingly, the present invention involves the chemical and material science fields.

BACKGROUND OF THE INVENTION

Chemical mechanical polishing (CMP) is an effective planarization process utilized in the semiconductor industry for manufacturing wafers of ceramic, silicon, glass, quartz, and metals, including the processes of inter-level dielectric (ILD) and Damascene metallization. Such polishing processes generally entail applying the wafer against a rotating pad made from a durable organic substance such as polyurethane. A slurry containing a chemical capable of breaking down the wafer substance is introduced onto the pad. The slurry additionally contains abrasive particles which act to physically erode the wafer surface. The slurry is continually added to the spinning CMP pad, and the dual chemical and mechanical forces exerted on the wafer cause it to be polished in a desired manner.

Of particular importance to the quality of polishing achieved, is the distribution of the abrasive particles across the surface of the pad. The top of the pad holds the particles, usually by a mechanism such as fibers, or small pores, which provide a friction force sufficient to prevent the particles from being thrown off of the pad due to the centrifugal force exerted by the pad's spinning motion. Therefore, it is important to keep the top of the pad as flexible as possible, to keep the fibers as erect as possible, and to assure that there are an abundance of open pores available to receive new abrasive particles.

One problem with maintaining the top of the pad results from an accumulation of debris from the work piece and the abrasive slurry. This accumulation causes a "glazing" or hardening of the top of the pad, and causes the fibers to mat down, thus making the pad less able to hold new abrasive particles from the ongoing slurry flow. This situation significantly decreases the pad's overall polishing performance. Therefore, attempts have been made to revive the top of the pad by "combing" or "cutting" it with various devices. This process has come to be known as "dressing" or "conditioning" the CMP pad. Many types of devices and processes have been used for this purpose. One such device is a dresser disk with a plurality of superabrasive particles, such as diamond, attached to a surface or substrate.

New dresser disks have sharp superabrasive particles that cut dense, deep asperities into the CMP pad surface. The slurry is effectively held in these deep asperities, resulting in a high polishing rate of the wafer. Through continued use, however, the superabrasive particles in the dresser disk begin to wear, and their tips begin to gradually dull. The dull superabrasive particles do not penetrate into the CMP pad surface as deeply and the cutting grooves becomes wider as the superabrasive particle tips wear down. This wearing effect results in asperities that are wide, sparse, and shallow. CMP pads conditioned with such a dresser disk can no longer effectively hold the slurry, thereby decreasing the polishing rate of the wafer. Superabrasive particles on the dresser disk will continue to wear until they are pressing into the pad without cutting. Also, less effective cutting by the dresser disk causes debris to collect on the CMP pad surface, resulting in uneven polishing and increased wafer scratching.

In view of the foregoing, methods of using and constructing CMP pad dresser disks that achieve optimal dressing results, with maximized efficiency and lifespan continue to be sought.

SUMMARY OF THE INVENTION

Accordingly, the present invention provides a method for extending the useful service life of a chemical mechanical polishing pad dresser used to dress a chemical mechanical polishing pad, the dresser having a substrate and a plurality of superabrasive particles disposed thereon. Such a method may include dressing the chemical mechanical polishing pad with the dresser and varying the pressure between the pad and the dresser in relation to superabrasive particle wear, such that the dresser life is extended. Such variations of pressure may include increases or decreases in pressure.

In one aspect, such a method may also include determining the extent of superabrasive particle wear. One way of accomplishing this includes an examination of a dressed CMP pad surface. In one aspect, pressure between the CMP pad and the dresser may be increased when the CMP pad surface exhibits a decrease in average asperity density. In another aspect, pressure may be increased when the CMP pad surface exhibits a decrease in average asperity depth. In yet another aspect, pressure may be increased when the CMP pad surface exhibits a decrease in average asperity width. In yet another aspect, pressure may be increased when the CMP pad surface exhibits a decrease in average asperity length. Additionally, determining the extent of superabrasive particle wear may include and examination of the superabrasive particles disposed on the dresser, or it may include an estimation of superabrasive particle wear based on dresser use.

Additionally, the pressure between the pad and the dresser may be increased due to a measurable phenomenon. For example, in one aspect a method may include detecting an increase in friction between the pad and the dresser due to superabrasive particle wear, and increasing the pressure between the pad and the dresser as a result of such an increase in friction.

Various methods of increasing the pressure between the pad and the dresser are contemplated. For example, the pressure can be increased manually or automatically. Such an increase can occur during a dressing operation, or between dressing operations. Additionally, in one aspect the pressure can be increased gradually over time. A gradual increase may include linear and non-linear increases in pressure. In another aspect, the pressure can be increased in a series of steps.

There has thus been outlined, rather broadly, various features of the invention so that the detailed description thereof that follows may be better understood, and so that the present contribution to the art may be better appreciated. Other features of the present invention will become clearer from the following detailed description of the invention, taken with the accompanying claims, or may be learned by the practice of the invention.

DETAILED DESCRIPTION OF THE INVENTION

Figure 1:
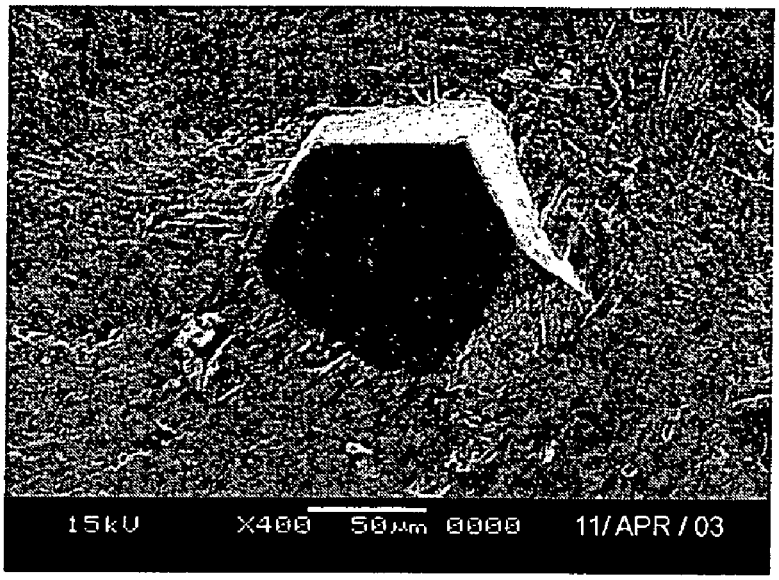
FIG. 1 is a photograph of superabrasive particle showing little wear.

Before the present methods are disclosed and described, it is to be understood that this invention is not limited to the particular process steps and materials disclosed herein, but is extended to equivalents thereof as would be recognized by those ordinarily skilled in the relevant arts. It should also be understood that terminology employed herein is used for the purpose of describing particular embodiments only and is not intended to be limiting.

It must be noted that, as used in this specification and the appended claims, the singular forms "a," and "the" include plural referents unless the context clearly dictates otherwise. Thus, for example, reference to an "abrasive particle" or a "pad" includes reference to one or more of such abrasive particles or pad.

DEFINITIONS

In describing and claiming the present invention, the following terminology will be used in accordance with the definitions set forth below.

As used herein, "superabrasive particle," "abrasive particle," "grit," or similar phrases mean any super hard crystalline, or polycrystalline substance, or mixture of substances, and include, but are not limited to, diamond, polycrystalline diamond (PCD), cubic boron nitride (CBN), and polycrystalline cubic boron nitride (PCBN). Further, the terms "superabrasive particle," "abrasive particle," "grit," "diamond," "polycrystalline diamond," "cubic boron nitride," and "polycrystalline cubic boron nitride," may be used interchangeably.

As used herein, "super hard" and "superabrasive" may be used interchangeably, and refer to a crystalline, or polycrystalline material, or mixture of such materials having a Vicker's hardness of about 4000 $Kg/mm^2$ or greater. Such materials may include without limitation, diamond, and cubic boron nitride (cBN), as well as other materials known to those skilled in the art. While superabrasive materials are very inert and thus difficult to form chemical bonds with, it is known that certain reactive elements, such as chromium and titanium are capable of chemically reacting with superabrasive materials at certain temperatures.

As used herein, "substrate" means the base portion of a CMP dresser having a surface on which the abrasive particles may be affixed. The base portion may be any shape, thickness, or material, and includes but is not limited to metals, alloys, ceramics, and mixtures thereof.

As used herein, "working surface" means the surface of a CMP pad dresser that, during operation, faces toward, or comes in contact with a CMP pad.

As used herein, "leading edge" means the edge of a CMP pad dresser that is a frontal edge based on the direction that the CMP pad is moving, or the direction that the pad is moving, or both. Notably, in some aspects, the leading edge may be considered to encompass not only the area specifically at the edge of a dresser, but may also include portions of the dresser which extend slightly inward from the actual edge. In one aspect, the leading edge may be located along an outer edge of the CMP pad dresser. In another aspect, the CMP pad dresser may be configured with a pattern of abrasive particles that provides at least one effective leading edge on a central or inner portion of the CMP pad dresser working surface. In other words, a central or inner portion of the dresser may be configured to provide a functional effect similar to that of a leading edge on the outer edge of the dresser.

As used herein, "sharp portion" means any narrow apex to which a crystal may come, including but not limited to corners, ridges, edges, obelisks, and other protrusions.

As used herein, "pressure" refers to the applied force between a CMP pad dresser and a CMP pad. Thus reference to increasing or decreasing pressure refers to variations in the applied force between the dresser and the pad that causes an increase or decrease in pressure.

As used herein, "dressing operation" refers to a period when the dresser is pressing against and actively dressing the pad.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc.

This same principle applies to ranges reciting only one numerical value. Furthermore, such an interpretation should apply regardless of the breadth of the range or the characteristics being described.

THE INVENTION

Figure 2:
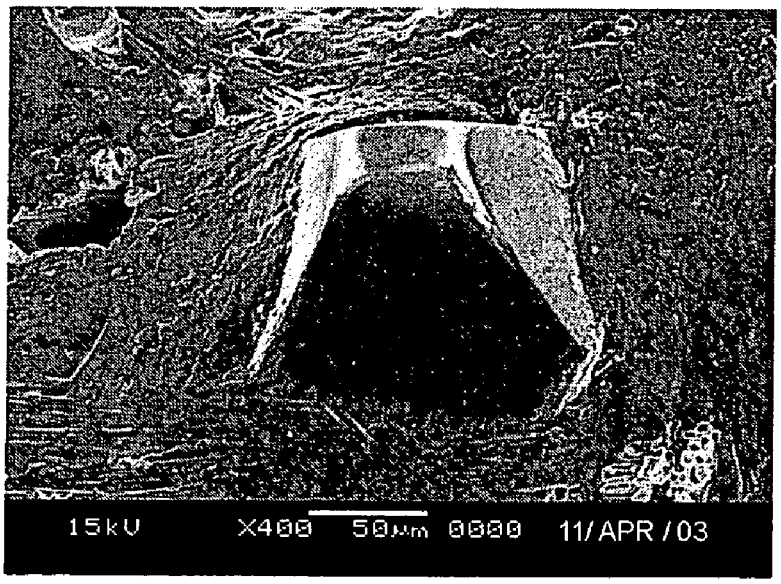
FIG. 2 is a photograph of a superabrasive particle showing some wear.
Figure 3:
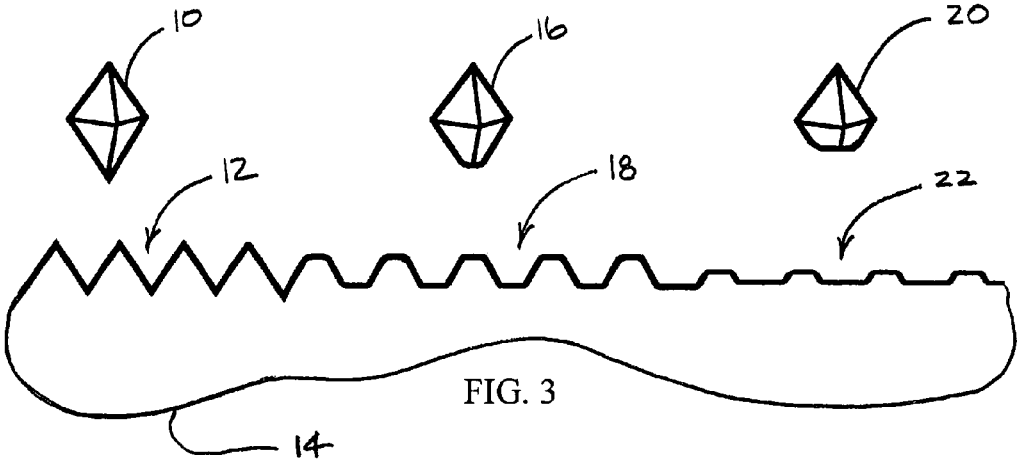
FIG. 3 is a illustrative diagram showing superabrasive particles and describing potential cutting patterns generated by the superabrasive particles according to an embodiment of the present invention.
Figure 4:
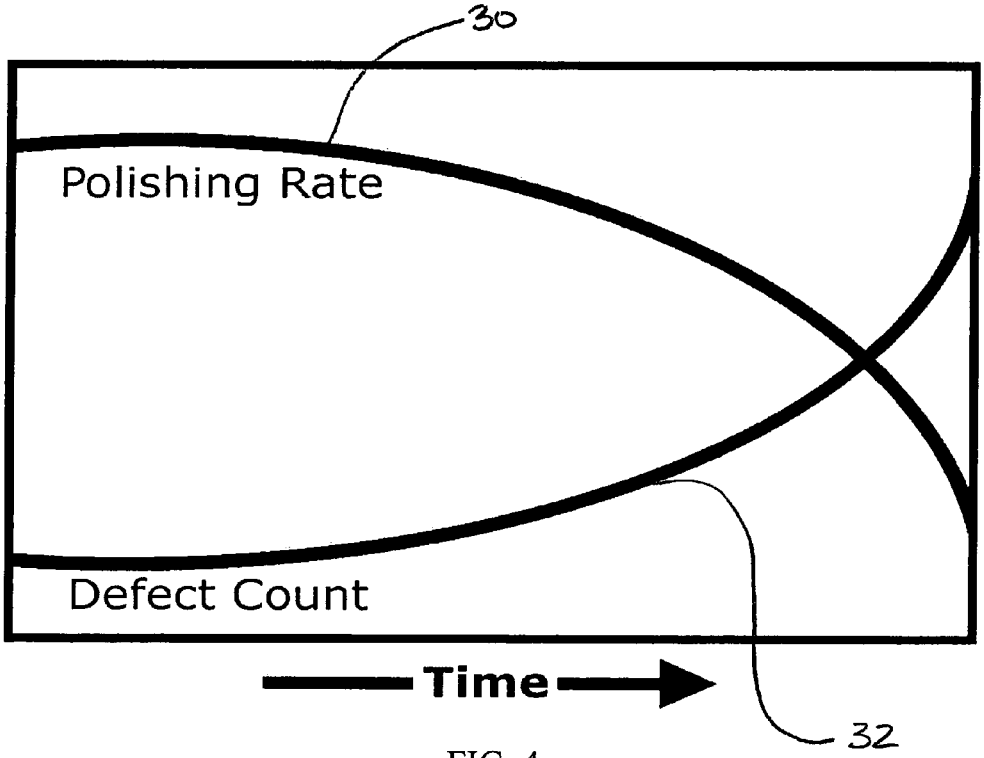
FIG. 4 is a graph depicting an example of polishing rate and defect count over time according to an embodiment of the present invention.

As previously discussed, CMP pad dressers are used to dress CMP pads in order to remove dirt and debris, and to restore asperities in the surface of the pad. Asperities are important to the function of the CMP pad, as they hold and channel slurry across the material being polished. Higher rates of polishing may be achieved when the CMP contains deep, dense asperities to hold the slurry. Sharp superabrasive particles such as diamond, as shown in FIG. 1, are able to cut such optimal asperities in the CMP pad that maximize retention of the slurry, and thus provide a high rate of polishing. As the dresser is used, the embedded superabrasive particles begin to wear over time, and their tips and edges become dull and rounded as shown in FIG. 2. Worn superabrasive particles cut less effectively into the CMP pad, resulting in a pad surface with asperities that are shallow, wider, and sparse. FIG. 3 is a diagrammatic representation that illustrates superabrasive particle wear and the subsequent effects on cutting patterns in the CMP pad. As superabrasive particles wear, cutting patterns of the dresser changes. Sharp superabrasive particles 10 cut deep asperities 12 in the surface of the CMP pad 14. As the superabrasive particles begin to wear 16, moderately deep asperities 18 are cut into the CMP pad surface 14. When superabrasive particles become significantly worn 20, very shallow asperities 22 are cut, if at all. The superabrasive particles eventually become so worn that they can no longer cut and/or clean, but merely rub against the pad surface. The surface of the pad becomes hard and covered with debris, increasing the rate of scratching and damage to the wafer or other work surface. As such, the polishing rate of the CMP pad will decline over time as the superabrasive particles wear. As shown in FIG. 4, as the service life of the CMP pad dresser increases (time), the polishing rate 30 decreases and the defect count 32 increases (FIG. 4).

The inventor has discovered that by varying the force applied to the CMP pad by the CMP pad dresser in relation to the level of wear of the superabrasive particles of the dresser, the service life of the dresser can be extended. For example, increasing the force between the CMP pad dresser and the CMP pad as the superabrasive particles wear leads to an increase in the service life of the dresser. By increasing the pressure, superabrasive particles press more deeply into the pad and thus cutting efficiency is increased. Additionally, such an increase in pressure will also allow a greater proportion of the superabrasive particles to come into contact with the pad surface. Superabrasive particles that do not protrude as far from the surface of the dresser can contact and dress the pad under increased pressure. Such an increase in pressure may be implemented before the superabrasive particles are completely worn, as significantly worn superabrasive particles tend to facilitate damage to the wafer. Accordingly, in one aspect a method for extending the service life of a CMP pad dresser having a substrate and a plurality of superabrasive particles disposed thereon when used to dress a CMP pad is provided. The method may further include dressing the CMP pad with the dresser and increasing pressure between the pad and the dresser in relation to superabrasive particle wear, such that the dresser life is extended.

Current practices tend to apply the dresser to the CMP pad with a fixed pressure, often about 10 lbs throughout the life of the dresser. Similarly, current dressing machines can only apply a fixed pressure and require that the machine be stopped in order for the pressure to be reset. Conversely, aspects of the present invention contemplate increasing the pressure between the CMP pad and the dresser as a result of actual or anticipated wear of the associated superabrasive particles. By increasing this applied force, the superabrasive particle tips can cut deeper into the CMP pad surface while the superabrasive particles are still in a condition to cut. Without wishing to be bound by theory, it is believed that increasing the pressure in relation to superabrasive particle wear may increase the service life of the tool because the increased pressure may offset such wear. It should be noted that an increase of applied force is most effective if accomplished prior to the superabrasive particles becoming too dull to penetrate the pad, regardless of the amount of pressure applied. The extent of the increase in pressure or applied force can readily be determined by one skilled in the art from examining the cutting pattern, examining the superabrasive particles, making estimations of superabrasive particle wear, etc. The amount of applied force will also be dependent on the dresser size, dresser machine specifications, and the type of polishing being performed. Given such variations, a simple range of how much to vary the pressure is not practical. One of ordinary skill in the art can, however, readily determine the necessary variations in pressure for a particular polishing process once in possession of the present disclosure. In one specific aspect, however, the pressure between the CMP pad and the CMP pad dresser may be increased by from about 1% to about 100%. In another specific aspect, the pressure may be increased by from about 1% to about 50%. In yet another specific aspect, the pressure may be increased by from about 1% to about 20%. In a further specific aspect, the pressure may be increased by from about 1% to about 10%. In another further specific aspect, the pressure may be increased by less than about 5%. In yet a further aspect the pressure may be increased by greater than about 100%.

It should also be understood that varying the pressure may also include decreasing the pressure, particularly for those dressers with superabrasive particles exhibiting little or no wear. Sharp superabrasive particles often cut more deeply into the CMP pad than is required to hold the slurry. Such "overdressing" causes the superabrasive particles to wear more quickly. By decreasing the pressure between the pad and the dresser when the superabrasive particles are sharp, overall wear of the particles may be reduced and the service life of the dresser can be further extended.

The timing and extent of the increase in pressure between the CMP pad dresser and the CMP pad may be facilitated by making a determination of superabrasive particle wear. Various methods of determining superabrasive particle wear are contemplated, all of which are considered to be within the scope of the present invention. Such a determination may be an actual determination or an estimation based on calculated or assumed wear patterns. Accordingly, as it is determined that superabrasive wear is occurring or has occurred, the applied force or pressure between the CMP pad dresser and the CMP pad may be varied accordingly in order to maintain more optimal asperity configurations in the surface of the CMP pad such as depth, width, density, etc.

In one aspect of the present invention, a determination of the extent of superabrasive particle wear may include an examination of a dressed CMP pad surface. The depth, width, density, etc., of the asperities cut into the CMP pad surface can give one skilled in the art some indication of the extent of the wear of the superabrasive particles. One advantage of this examination method is the ability to estimate superabrasive particle wear without the need of removing the dresser from the polishing apparatus. Such examination can occur manually through visual observation with or without a magnification apparatus, or by other means of ascertaining the CMP pad surface texture. Examination can also occur automatically through visual imaging or mechanical measuring processes.

Virtually any aspect of the pattern of asperities can be utilized to evaluate the extent of superabrasive particle wear and thus trigger a variation in pressure. By improving at least one characteristic of the pattern of asperities by varying the cutting pressure, slurry can be more effectively held on the surface of the CMP pad, polishing rate may be improved, and the service life of the dresser will be increased. In one aspect, the pressure may be increased when the CMP pad surface exhibits a decrease in average asperity density. Such a decrease in density may occur due to an increase in width, a decrease in length, etc. It may also be a result of ineffective cutting by the superabrasive particles. Dull superabrasive particles may only intermittently cut the CMP pad surface, thus decreasing the density of asperities thereon.

In another aspect, the pressure may be increased when the CMP pad surface exhibits a decrease in average asperity depth. As the superabrasive particles begin to dull they no longer have sharp tips and edges that allow deep asperities to be cut. By increasing the cutting pressure, the superabrasive particles will be pressed further into the CMP pad surface, thus cutting deeper asperities that can hold more slurry.

In yet another aspect, the pressure may be increased when the CMP pad surface exhibits a decrease in average asperity width. As has been described, as the superabrasive particles wear, their tips and edges become rounded and smooth. As the tips and edges wear off, these particles begin to cut wider asperities that reflect their now-worn surfaces. Though increasing pressure may not decrease the width of the asperities back to pre-dull levels, it may allow deeper asperities to be cut, thus allowing retention of larger amounts of slurry during polishing.

In a further aspect, the pressure may be increased when the CMP pad surface exhibits a decrease in average asperity length. As the tips and edges of the superabrasive particles wear, they have a tendency to locally deform the surface of the CMP pad rather than cut asperities in it. As such, worn superabrasive particles tend to intermittently cut and deflect the surface, thus creating asperities with a decreased average length. By increasing the downward pressure of the superabrasive particles, cutting can be prolonged, thus increasing the average length of the asperities in the pad surface.

Additionally, if the CMP pad surface asperities are deeper, wider, longer, or denser that what is required to hold the slurry, the pressure between the pad and the dresser may be decreased to slow down the wear of the superabrasive particles, and thus extend the service life of the dresser.

Another method of determining the extent of superabrasive particle wear may include an examination of at least a portion of the plurality of superabrasive particles disposed on the dresser. Though direct examination of the condition of the superabrasive particles may entail removing the dresser from the surface of the CMP pad, such an examination may provide a more accurate assessment of the surface of the dresser than merely observing the cutting pattern of the tool. Following such an assessment, the pressure applied by the dresser to the surface of the CMP pad can be varied relative to the amount of superabrasive particle wear observed.

Yet another method of determining the extent of superabrasive particle wear may include an estimation of superabrasive particle wear based on dresser use. Over time, one skilled in the art may be able to estimate superabrasive particle wear patterns based on wear patterns of previous CMP pad dressers. In many situations this estimation method may prove to be beneficial due to its cost effective nature. Varying the pressure between the CMP pad dresser and the surface of the pad due to estimated superabrasive particle wear patterns precludes the need for stopping the polishing process to examine the surface of the CMP pad or the condition of the superabrasive particles in the dresser.

Various methods of altering the pressure between the CMP pad dresser and the pad surface are contemplated, and all would be considered to be within the scope of the present invention. For example, in one aspect varying the pressure may include a manual adjustment. When it is determined that the superabrasive particles on the dresser have become worn, the pressure can be varied manually to take into account and thus counteract such a worn condition. Such a manual change may occur as a result of observing the asperities in the pad surface, examining the condition of the superabrasive particles on the dresser, or estimating the amount of wear based on dresser use.

It is also contemplated that the pressure between the CMP pad dresser and the pad surface may be varied automatically. Numerous automatic methods are possible, including automatic variations as a result of observations of superabrasive particle wear, estimations of superabrasive particle wear, anticipation of superabrasive particle wear, etc. This may include notification of the observed wear of the superabrasive particles followed by an automatic increase. Alternatively, the pressure may be increased as the dresser has been utilized to a point that an estimated level of superabrasive particle wear has been achieved. In one aspect, a computer control is utilized to automatically vary the pressure. Such a computer control may allow the increase of pressure over a large number of polished wafers. As such, in one aspect the pressure can be initially increased by very small increments when the superabrasive particles are sharp, and subsequently increased by larger amounts as they begin to dull. For example, the pressure can be increased by about 1% for the first 500 wafers polished, 5% for the next 500 wafers polished, 10% for the next 500 wafers polished, etc. In another aspect, the computer control can increase the amount of pressure for each successive wafer in order to more effectively extend the service life of the dresser.

Other pressure increasing methods may include situations where the pressure is increased without regard to actual or estimated wear. In one aspect, the pressure between the pad and the dresser may be gradually increased over time as the dresser is used. For example, in one aspect the pressure between the pad and the dresser may be increased following a dressing operation. In those cases where the dresser is intermittently dressing the pad while the pad is polishing a wafer, the pressure may be increased following one or more dressing operations during polishing. The pressure may also be increased following each dressing operation of the dresser. In another aspect, the pressure may be increased during a dressing operation. This would entail increasing the pressure between the pad and the dresser while the dresser is in contact with and is actively dressing the pad. In yet another aspect, the pressure between the pad and the dresser is increased following completion of polishing of a wafer. Pressure may be increased following the polishing of a set number of wafers, or it may be increase following the polishing of each wafer.

Various non-limiting examples of gradually increasing pressure may include linear increases, non-linear increases, exponential or logarithmic increases, stepwise increases, etc. This method provides the benefit of not requiring an examination or estimation step to ascertain superabrasive particle wear. Additionally, pressure may be increased in anticipation of a worn condition. It may be the case that the service life of a CMP pad dresser may be further increased by varying pressure in anticipation of rather than as a result of superabrasive particle wear.

Various methods of varying pressure may also include the automatic detection of phenomenon that may be indicative of a given level of superabrasive particle wear. For example, as the superabrasive particles on the dresser begin to become dull and rounded, friction between the dresser and the pad may increase. In one aspect, such an increase in friction due to superabrasive particle wear may be detected, and the pressure between the pad and the dresser may be increased in order to compensate.

It is to be understood that the above-described compositions and methods are only illustrative of preferred embodiments of the present invention. Numerous modifications and alternative arrangements may be devised by those skilled in the art without departing from the spirit and scope of the present invention and the appended claims are intended to cover such modifications and arrangements.

Thus, while the present invention has been described above with particularity and detail in connection with what is presently deemed to be the most practical and preferred embodiments of the invention, it will be apparent to those of ordinary skill in the art that numerous modifications, including, but not limited to, variations in materials, temperature, function, order, amount, and manner of operation, assembly and use may be made without departing from the principles and concepts set forth herein.

What is claimed is:

1. A method for extending the service life of a chemical mechanical polishing pad dresser used to dress a chemical mechanical polishing pad, the dresser having a substrate and a plurality of superabrasive particles disposed thereon, comprising:

dressing the chemical mechanical polishing pad with the dresser;

determining superabrasive particle wear by examining at least a portion of the plurality of superabrasive particles; and varying pressure between the pad and the dresser in relation to superabrasive particle wear, such that the dresser life is extended wherein varying the pressure between the pad and the dresser includes gradually increasing the pressure between the pad and the dresser, wherein the pressure between the pad and the dresser is automatically increased in response to dresser superabrasive particle wear.

2. The method of claim 1, wherein determining superabrasive particle wear includes examination of a dressed chemical mechanical polishing pad surface.

3. The method of claim 2, wherein pressure is increased when the chemical mechanical polishing pad surface exhibits a decrease in average asperity density.

4. The method of claim 2, wherein pressure is increased when the chemical mechanical polishing pad surface exhibits a decrease in average asperity depth.

5. The method of claim 2, wherein pressure is increased when the chemical mechanical polishing pad surface exhibits a decrease in average asperity width.

6. The method of claim 2, wherein pressure is increased when the chemical mechanical polishing pad surface exhibits a decrease in average asperity length.

7. The method of claim 1, wherein determining superabrasive particle wear includes an estimation of superabrasive particle wear based on dresser use.

8. The method of claim 1, wherein the pressure between the pad and the dresser is gradually increased over time as the dresser is used.

9. The method of claim 8, wherein the gradual increase over time is non-linear.

10. The method of claim 9, wherein the non-linear gradual increase is an exponential increase.

11. The method of claim 1, wherein the pressure between the pad and the dresser is increased following a dressing operation of the dresser.

12. The method of claim 1, wherein the pressure between the pad and the dresser is increased following each dressing operation of the dresser.

13. The method of claim 1, wherein the pressure between the pad and the dresser is increased during a dressing operation.

14. The method of claim 1, wherein the pressure between the pad and the dresser is increased following completion of polishing of a wafer.

15. The method of claim 1, wherein the pressure between the pad and the dresser is increased for each wafer polished by the pad.

16. The method of claim 1, wherein varying the pressure between the pad and the dresser includes decreasing the pressure between the pad and the dresser.

17. The method of claim 1, wherein the pressure between the pad and the dresser is decreased following dresser replacement.

18. A method for extending the service life of a chemical mechanical polishing pad dresser used to dress a chemical mechanical polishing pad, the dresser having a substrate and a plurality of superabrasive particles disposed thereon, comprising:

dressing the chemical mechanical polishing pad with the dresser; and varying the pressure between the pad and the dresser, including gradually increasing the pressure between the pad and the dresser in a non-linear manner over time as the dresser is used, such that the dresser life is extended, wherein pressure is increased when the chemical mechanical polishing pad surface exhibits a decrease in an asperity property selected from average asperity density, average asperity depth average asperity width, average asperity length, and combinations thereof.

19. The method of claim 18, further comprising determining superabrasive particle wear.

20. The method of claim 19, wherein determining superabrasive particle wear includes examination of a dressed chemical mechanical polishing pad surface.

21. The method of claim 20, wherein pressure is increased when the chemical mechanical polishing pad surface exhibits a decrease in average asperity density.

22. The method of claim 20, wherein pressure is increased when the chemical mechanical polishing pad surface exhibits a decrease in average asperity depth.

23. The method of claim 20, wherein pressure is increased when the chemical mechanical polishing pad surface exhibits a decrease in average asperity width.

24. The method of claim 20, wherein pressure is increased when the chemical mechanical polishing pad surface exhibits a decrease in average asperity length.

25. The method of claim 19, wherein determining superabrasive particle wear includes examination of at least a portion of the plurality of superabrasive particles disposed on the dresser.

26. The method of claim 20, wherein determining superabrasive particle wear includes an estimation of superabrasive particle wear based on dresser use.

27. The method of claim 18, wherein the non-linear gradual increase is an exponential increase.

28. The method of claim 18, wherein the pressure between the pad and the dresser is increased following a dressing operation of the dresser.

29. The method of claim 18, wherein the pressure between the pad and the dresser is increased following each dressing operation of the dresser.

30. The method of claim 18, wherein the pressure between the pad and the dresser is increased during a dressing operation.

31. The method of claim 18, wherein the pressure between the pad and the dresser is increased following completion of polishing of a wafer.

32. The method of claim 18, wherein the pressure between the pad and the dresser is increased for each wafer polished by the pad.

33. The method of claim 18, wherein the pressure between the pad and the dresser is automatically increased.

34. The method of claim 18, wherein the pressure between the pad and the dresser is decreased following dresser replacement.

35. The method of claim 18, further comprising:

detecting an increase in friction between the pad and the dresser due to superabrasive particle wear; and increasing the pressure between the pad and the dresser as a result of the increase in friction.

* * * * *